US011768031B1

(12) United States Patent
Schroeder et al.

(10) Patent No.: US 11,768,031 B1
(45) Date of Patent: Sep. 26, 2023

(54) REFRIGERATOR APPLIANCE AND METHODS FOR RESPONDING TO AMBIENT HUMIDITY LEVELS

(71) Applicant: Haier US Appliance Solutions, Inc., Wilmington, DE (US)

(72) Inventors: Michael Goodman Schroeder, Crestwood, KY (US); Stephanos Kyriacou, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/879,452

(22) Filed: Aug. 2, 2022

(51) Int. Cl.
*F25D 29/00* (2006.01)

(52) U.S. Cl.
CPC ..... *F25D 29/005* (2013.01); *F25D 2700/02* (2013.01)

(58) Field of Classification Search
CPC .... F25D 29/00; F25D 29/005; F25D 2500/04; F25D 2600/00; F25D 2700/02
See application file for complete search history.

(56) References Cited

U.S. PATENT DOCUMENTS

| | | | |
|---|---|---|---|
| 10,371,439 | B2 | 8/2019 | Marutani et al. |
| 11,160,393 | B2 | 11/2021 | Kirshnamoorthy et al. |

FOREIGN PATENT DOCUMENTS

| | | | | |
|---|---|---|---|---|
| AU | 2017423650 | A1 * | 12/2019 | ..... F25D 21/04 |
| EP | 2851636 | A1 * | 3/2015 | ..... F25D 17/062 |
| KR | 100673706 | B1 | 1/2007 | |
| WO | WO2020045958 | A1 | 3/2020 | |

OTHER PUBLICATIONS

JP 2000/356446 (English translation) (Year: 2000).*

* cited by examiner

*Primary Examiner* — Jonathan Bradford
(74) *Attorney, Agent, or Firm* — Dority & Manning, P.A.

(57) ABSTRACT

A refrigerator appliance may include a cabinet, a door, a humidity sensor, and a controller. The cabinet may define a chilled chamber. The door may be rotatably hinged to the cabinet to move between an open position and a closed position. The humidity sensor may be mounted to the cabinet within the chilled chamber. The controller may be operably coupled to the humidity sensor. The controller may be configured to initiate an operation routine. The operation routine may include detecting a first humidity level within the cabinet in response to the door being in the open position, detecting a second humidity level within the cabinet when the door is in the closed position following detecting the first humidity level, determining an ambient humidity level outside of the cabinet based on the first and second humidity levels, and transmitting the determined ambient humidity level to a secondary appliance.

18 Claims, 5 Drawing Sheets

REFRIGERATOR APPLIANCE AND METHODS FOR RESPONDING TO AMBIENT HUMIDITY LEVELS

FIELD OF THE INVENTION

The present subject matter relates generally to refrigerator appliances, and more particularly to methods of detecting and responding to ambient humidity levels at a refrigerator appliances.

BACKGROUND OF THE INVENTION

Refrigerator appliances generally include a cabinet that defines a chilled chamber for receipt of food articles for storage. The refrigerator appliances can also include various storage components mounted within the chilled chamber and designed to facilitate storage of food items therein. Such storage components can include racks, bins, shelves, or drawers that receive food items and assist with organizing and arranging of such food items within the chilled chamber. One or more sensors, such as a temperature or humidity sensor, may be provided within the chilled chamber such that one or more features can be affected to vary or maintain conditions with the chilled chamber.

Although existing refrigerator appliances are generally configured to detect and respond to conditions within the chilled chamber, typical refrigerator appliances are unable to detect or respond to air conditions (e.g., humidity) in the ambient region (e.g., room or building) surrounding the refrigerator appliance. Nonetheless, such conditions may impact appliance performance or a user's general comfort. For instance, high ambient humidity levels may lead to increased condensation (e.g., on or within the refrigerator appliance). Moreover, such levels may lead to user discomfort within the corresponding room. Although other air appliances (e.g., a dehumidifier appliance, air conditioning appliance, or vent hood) may be useful to alleviate or impact ambient air conditions, it may be difficult for such air appliances to always detect ambient air conditions (e.g., at a refrigerator appliance apart from another appliance). Simply mounting or placing dedicated air sensors at different portions of a room (e.g., on a refrigerator appliance) for detecting ambient air conditions can be expensive or difficult to implement.

As a result, refrigerator appliance or methods for responding to ambient air conditions would be useful. In particular, it may be advantageous to provide a refrigerator appliance or method to indirectly detect ambient air conditions (e.g., such that such conditions may be addressed at the same refrigerator appliance or by a secondary appliance).

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a refrigerator appliance is provided. The refrigerator appliance may include a cabinet, a door, a humidity sensor, and a controller. The cabinet may define a chilled chamber. The door may be rotatably hinged to the cabinet to move between an open position and a closed position. The humidity sensor may be mounted to the cabinet within the chilled chamber. The controller may be operably coupled to the humidity sensor. The controller may be configured to initiate an operation routine. The operation routine may include detecting a first humidity level within the cabinet in response to the door being in the open position, detecting a second humidity level within the cabinet when the door is in the closed position following detecting the first humidity level, determining an ambient humidity level outside of the cabinet based on the first and second humidity levels, and transmitting the determined ambient humidity level to a secondary appliance.

In another exemplary aspect of the present disclosure, a method of operating a refrigerator appliance is provided. The method may include detecting a first humidity level within a cabinet of the refrigerator appliance in response to a door of the refrigerator appliance being in an open position. The method may further include detecting a second humidity level within the cabinet when the door is in a closed position following detecting the first humidity level. The method may still further include determining an ambient humidity level outside of the cabinet based on the first and second humidity levels and transmitting the determined ambient humidity level to a secondary appliance.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
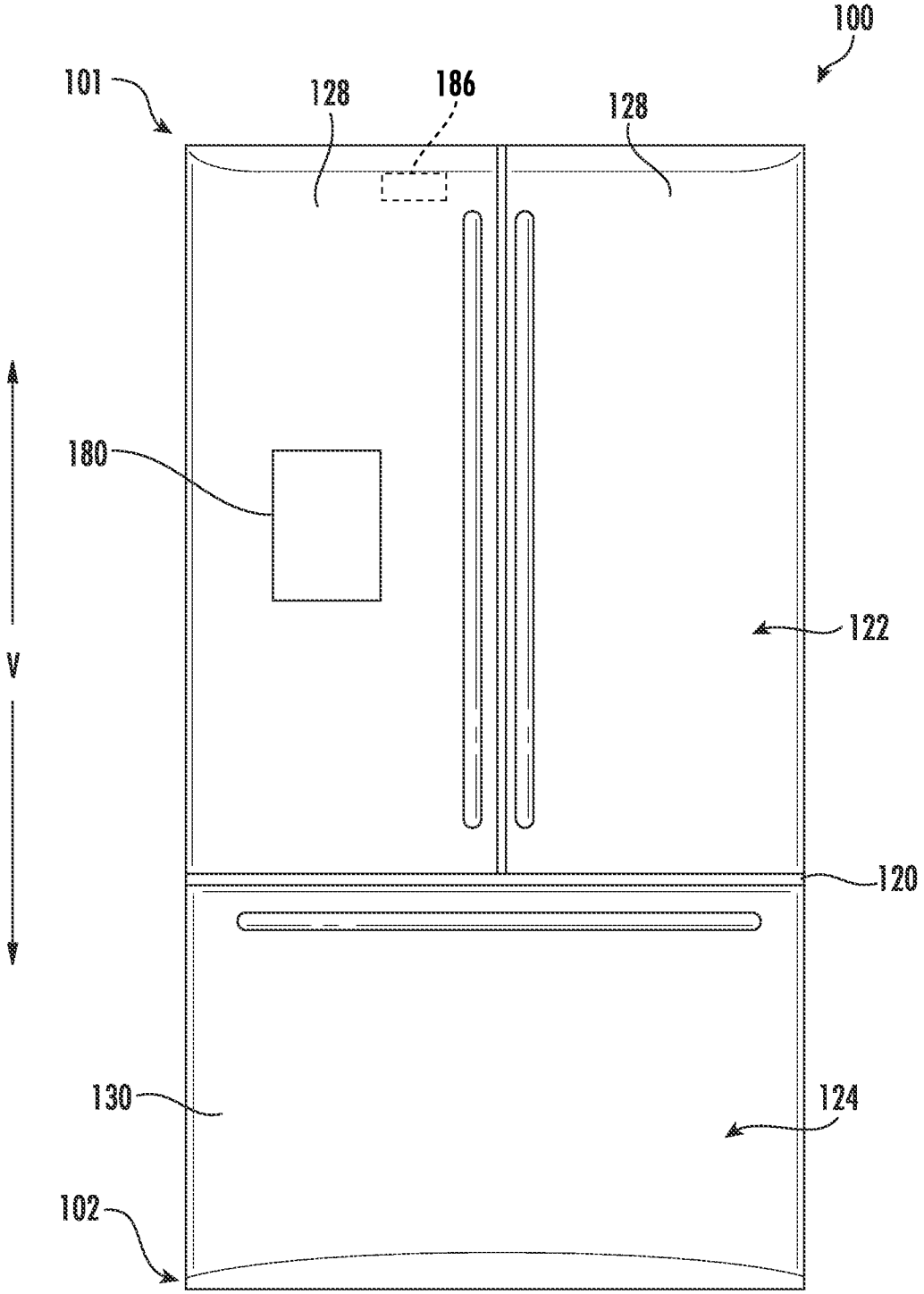
FIG. 1 provides a front elevation view of a refrigerator appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Generally, the present disclosure provides systems and methods to aid in detecting ambient air conditions at a refrigerator appliance (e.g., without requiring a dedicated humidity sensor for directly detecting ambient humidity levels). Such detected conditions may be communicated to a secondary appliance mounted apart from the refrigerator appliance. In turn, certain conditions (e.g., excessive humidity or poor air quality) may be addressed at the secondary appliance or the refrigerator appliance.

Figure 2:
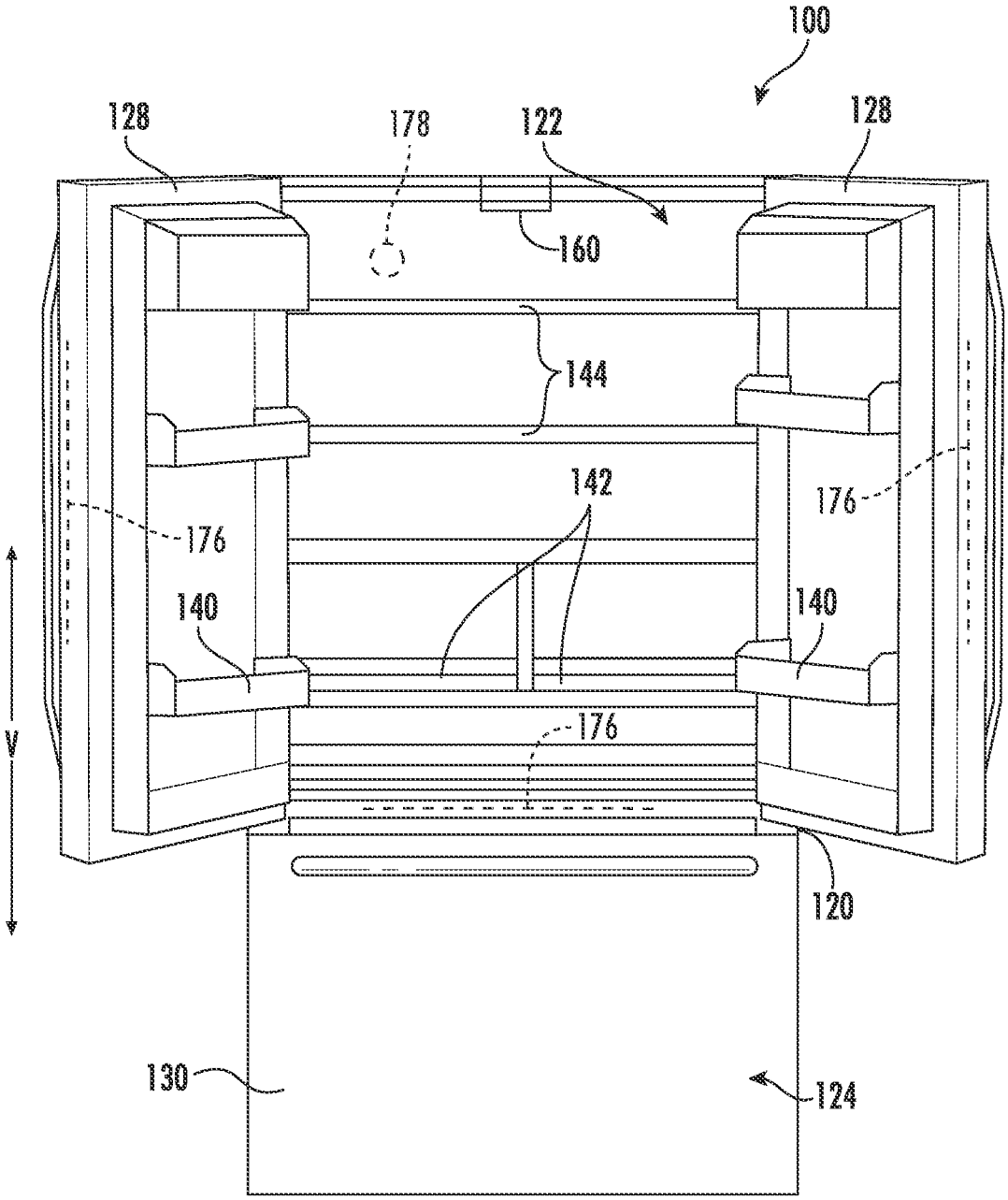
FIG. 2 provides a front elevation view of a refrigerator appliance according to exemplary embodiments of the present disclosure, wherein refrigerator doors are shown in an open position.

Turning now to the figures, FIG. 1 provides a front elevation view of a refrigerator appliance 100 according to exemplary embodiments of the present disclosure with refrigerator doors 128 of the refrigerator appliance 100 shown in a closed position. FIG. 2 provides a front view elevation of refrigerator appliance 100 with refrigerator doors 128 shown in an open position to reveal a fresh food chamber 122 of refrigerator appliance 100.

Refrigerator appliance 100 includes a housing or cabinet 120 that extends between a top 101 and a bottom 102 along a vertical direction V. Cabinet 120 defines chilled chambers for receipt of food items for storage. In particular, cabinet 120 defines fresh food chamber 122 positioned at or adjacent top 101 of cabinet 120 and a freezer chamber 124 arranged at or adjacent bottom 102 of cabinet 120. As such, refrigerator appliance 100 is generally referred to as a bottom mount refrigerator. It is recognized, however, that the benefits of the present disclosure apply to other types and styles of storage enclosure, such as a top mount refrigerator appliance, a side-by-side style refrigerator appliance, or an unrefrigerated pantry enclosure. Consequently, the description set forth herein is for illustrative purposes only and is not intended to be limiting in any aspect to any particular storage enclosure or refrigerator chamber configuration.

Refrigerator doors 128 are rotatably hinged to an edge of cabinet 120 for selectively accessing fresh food chamber 122. In addition, a freezer door 130 is arranged below refrigerator doors 128 for selectively accessing freezer chamber 124. Freezer door 130 is coupled to a freezer drawer 142 (not shown) slidably mounted within freezer chamber 124. As discussed above, refrigerator doors 128 and freezer door 130 are shown in the closed configuration in FIG. 1, and refrigerator doors 128 are shown in the open position in FIG. 2.

Turning now to FIG. 2, various storage components are mounted within fresh food chamber 122 to facilitate storage of food items therein as will be understood by those skilled in the art. In particular, the storage components include bins 140, drawers 142, and shelves 144 that are mounted within fresh food chamber 122. Bins 140, drawers 142, and shelves 144 are configured for receipt of stored items (e.g., beverages or solid food items) and may assist with organizing such food items. As an example, drawers 142 can receive fresh food items (e.g., vegetables, fruits, or cheeses) and increase the useful life of such fresh food items.

Figure 4:
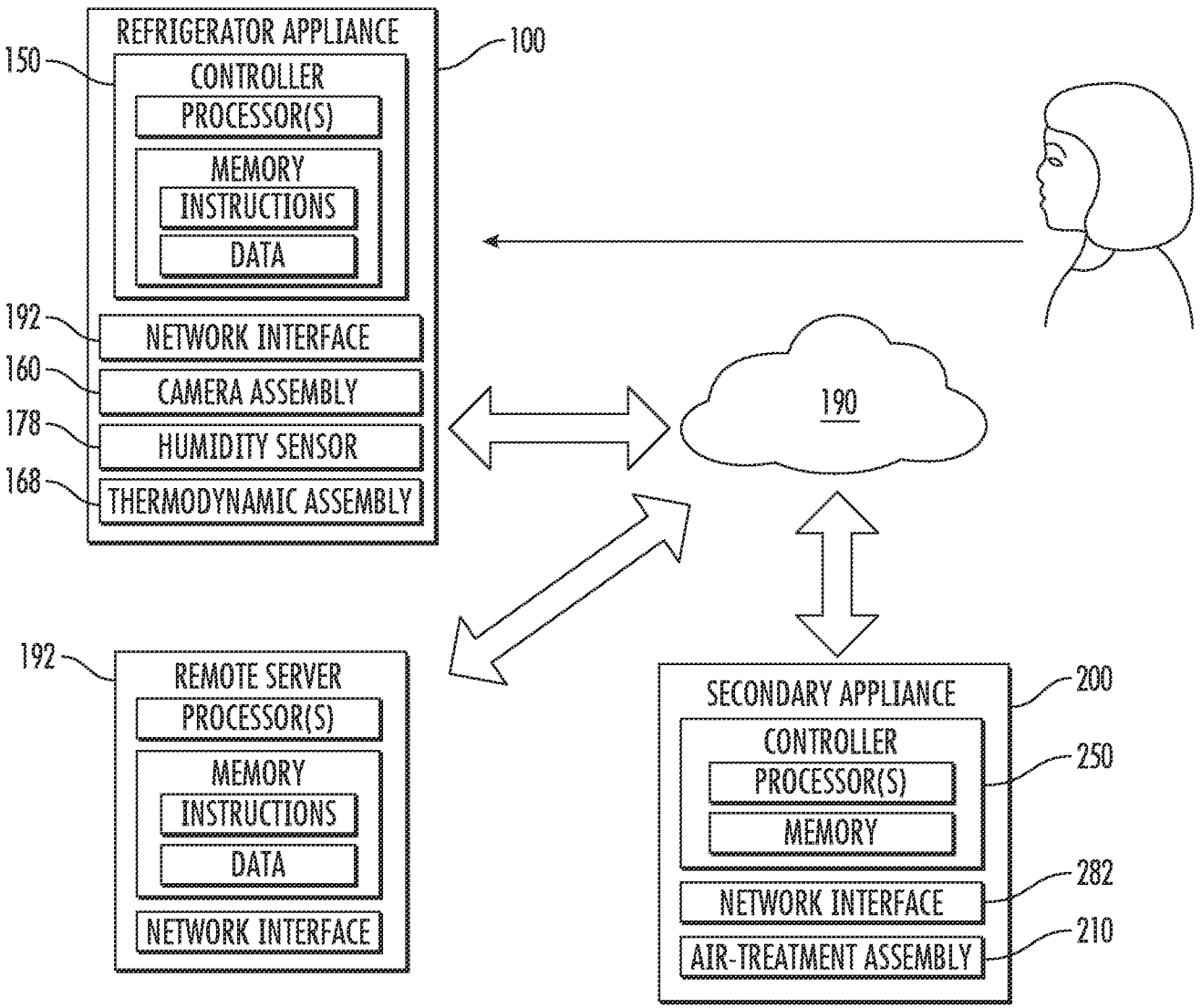
FIG. 4 provides another schematic view of an air-responsive system, including a refrigerator appliance, according to exemplary embodiments of the present disclosure.

In some embodiments, one or more heating elements 176 may be attached to (e.g., mounted on or within) cabinet 120 (e.g., as part of a thermodynamic assembly 168—FIG. 4). For instance, a heating element 176 may be disposed on or embedded within a wall of cabinet 120, one or more refrigerator doors 128, freezer door 130, or a door mullion (e.g., movably attached to refrigerator door 128). Optionally, heating element 176 may be constructed as, for instance, a loop of resistive wire that becomes heated upon the flow of an electrical current therethrough. Additionally, heating element 176 may include a plug (not shown) for connection to a power supply or controller 150, as would be understood.

In certain embodiments, a humidity sensor 178 is mounted within cabinet 120. Specifically, humidity sensor 178 may be disposed on or within a chilled chamber (e.g., fresh food chamber 122). Humidity sensor 178 may be any suitable humidity sensor. For example, humidity sensor 178 may include be provided as a capacitive, resistive, or thermal conductivity humidity sensor (e.g., with or without a dedicated temperature sensor), as would be understood. Moreover, humidity sensor 178 may be generally configured to detect measure the humidity of air within corresponding chilled chamber (e.g., the humidity lever of air within fresh food chamber 122). For instance, humidity sensor 178 may be configured to transmit one or more humidity signals to a controller 150, such signal corresponding to the humidity (e.g., relative humidity or absolute humidity) detected at humidity sensor 178.

Referring generally to FIGS. 1 through 4, FIGS. 3 and 4 provide schematic views of an air-responsive system, including refrigerator appliance 100 and a secondary appliance 200 (e.g., within a common room or building as refrigerator appliance 100).

As shown, refrigerator appliance 100 includes a controller 150 that is operatively coupled to, or in communication with, components of a thermodynamic assembly 168 of refrigerator appliance 100 configured for cooling fresh food chamber 122 or freezer chamber 124. The components may include a compressor 170, an evaporator fan 172, and a condenser fan 174. Controller 150 can selectively operate such components in order to cool fresh food chamber 122 or freezer chamber 124. Controller 150 is also in communication with a thermostat 152 (e.g., a thermocouple or thermistor). The thermostat 152 may be positioned in fresh food compartment 122 or freezer compartment 124. Controller 150 may receive a signal from the thermostat 152 that corresponds to a temperature of fresh food compartment 122 or freezer compartment 124. Controller 150 may also include an internal timer for calculating elapsed time periods.

Controller 150 may include a memory and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In some embodiments, the processor executes non-transitory programming instructions stored in memory. For certain embodiments, the instructions include a software package configured to operate appliance 100 or execute an operation routine (e.g., the exemplary method 500 described below with reference to FIG. 5). The memory may be a separate component from the processor or may be included onboard within the processor. Alternatively, controller 150 may be constructed without using a microprocessor (e.g., using a combination of discrete analog or digital logic circuitry; such as switches, amplifiers, integrators, comparators, flip-flops, AND gates, and the like) to perform control functionality instead of relying upon software.

In optional embodiments, refrigerator appliance 100 also includes a camera or camera module 160. Camera 160 may be any type of device suitable for capturing a two-dimensional picture or image. As an example, camera 160 may be a video camera or a digital camera with an electronic image sensor [e.g., a charge coupled device (CCD) or a CMOS sensor]. When assembled, camera 160 is in communication (e.g., electric or wireless communication) with controller 150 such that controller 150 may receive a signal from camera 160 corresponding to the image captured by camera 160.

Generally, camera 160 is positioned on refrigerator appliance 100. In some embodiments, camera 160 is mounted within fresh food chamber 122 at a top portion thereof (e.g., adjacent top 101). For instance, camera 160 may be fixed to or directed through a top wall of an internal liner defining fresh food chamber 122. In such embodiments, camera 160 may be directed downward, as illustrated in FIG. 2. During use, camera 160 may detect the opening or closing of one or more refrigerator doors 128 (e.g., based on detected changes of light), as would be understood in light of the present disclosure. Thus, camera 160 may be configured to effectively transmit discrete open-door signals and closed door signals (e.g., according to whether one or more doors 128 are in an open position or closed position).

Separate from or in addition to camera 160, refrigerator appliance 100 may include a door switch 186 (e.g., reed switch, pusher switch, Hall effect sensor, etc.) selectively engaged with a door (e.g., refrigerator door 128) to detect if/when the corresponding door is in a nominally open position (e.g., when door switch 186 is depressed or unengaged) or a nominally closed position. For instance, an open-door signal may be received from the door switch 186 in response to a corresponding refrigerator door 128 being moved to a nominally open position (e.g., wherein the door switch 186 closes an electric circuit or transmits a data signal corresponding to the nominally open position). Similarly, a closed-door signal may be received from the door switch 186 in response to the refrigerator door 128 being moved to a nominally closed position (e.g., wherein the door switch 186 opens an electric circuit or transmits a data signal corresponding to the nominally closed position). Generally, door switches 186 would be understood and may, for instance, simultaneously control activation of a light for illuminating the corresponding chilled chamber (e.g., fresh food chamber 122).

In certain embodiments, refrigerator appliance 100 includes a user interface or control panel 180 for controlling the mode of operation, or appliance 100. In some such embodiments, user interface panel 180 includes one or more inputs or interfaces (e.g., tactile inputs, such as buttons, or a graphical user interface) for selecting a desired mode of operation, or directing operation generally. Additionally or alternatively, an integrated display may be provided, such as a liquid crystal display panel (LCD), a plasma display panel (PDP), or any other suitable mechanism for displaying an image (e.g., a projector) to visually communicate one or more messages (e.g., visual alerts) to a user. User interface panel 180 may be mounted on refrigerator door 128 (FIG. 1) or at any other suitable location on refrigerator appliance 100.

In additional or alternative embodiments, refrigerator appliance 100 includes a network interface 182 that couples refrigerator appliance 100 (e.g., controller 150) to a network 190 such that refrigerator appliance 100 can transmit and receive information over network 190. Network 190 can be any wired or wireless network such as a WAN, LAN, or HAN.

In some embodiments, one or more remote servers 192, such as a web server, is in operable communication with controller 150.

The remote server 192 can be implemented using any suitable computing device(s). The remote server 192 may include one or more processors and one or more memory devices (i.e., memory). The one or more processors can be any suitable processing device (e.g., a processor core, a microprocessor, an ASIC, a FPGA, a microcontroller, etc.) and can be one processor or a plurality of processors that are operatively connected. The memory device can include one or more non-transitory computer-readable storage mediums, such as RAM, ROM, EEPROM, EPROM, flash memory devices, magnetic disks, etc., and combinations thereof. The memory devices can store data and instructions which are executed by the processor to cause remote server 192 to perform operations.

The memory devices may also include data, such as detected air conditions (e.g., humidity levels), that can be retrieved, manipulated, created, or stored by processor. The data can be stored in one or more databases. The one or more databases can be connected to remote server 192 by a high bandwidth LAN or WAN, or can also be connected to remote server 192 through network 190. The one or more databases can be split up so that they are located in multiple locales.

Remote server 192 includes a network interface such that remote server 192 can connect to and communicate over one or more networks (e.g., network 190) with one or more network nodes. In turn, remote server 192 can exchange data with one or more nodes over the network 190. In particular, remote server 192 can exchange data with controller 150. Moreover, it is understood that remote server 192 may further exchange data with any number of client devices over the network 190 (e.g., a secondary appliance 200).

In some embodiments, refrigerator appliance 100 is in operative communication with a secondary appliance 200 (e.g., directly through network 190 or via remote server 192). Generally, secondary appliance 200 may be mounted within a common area (e.g., the same room or building as refrigerator appliance 100) and may include any suitable air-treatment assembly 210 for affecting the humidity, quality, or state of air surrounding refrigerator appliance 100. For example, secondary appliance 200 may include or be provided as a dehumidifier appliance, air conditioning appliance (e.g., PTAC, VTAC, or central conditioning unit), or vent hood (e.g., mounted above a cooking appliance). Thus, the air-treatment assembly 210 may include a separate thermodynamic assembly (e.g., sealed system), fan(s), or dampers for treating air within the common ambient environment surrounding refrigerator appliance 100, as would be understood.

Secondary appliance 200 may include a secondary-appliance (SA) controller 250 configured to direct operation of the secondary appliance 200 (e.g., in response to one or more signals received from refrigerator appliance 100). SA controller 250 may also be communicatively coupled with various operational components of secondary appliance 200, such as air-treatment assembly 210, sensors, etc. Input/output ("I/O") signals may be routed between SA controller 250 and the various operational components of secondary appliance 200. Thus, SA controller 250 can selectively activate and operate these various components. Various components of secondary appliance 200 are communicatively coupled with SA controller 250 via one or more communication lines such as, for example, conductive signal lines, shared communication busses, or wireless communications bands.

In some embodiments, SA controller 250 includes one or more memory devices and one or more processors. The processors can be any combination of general or special purpose processors, CPUs, or the like that can execute programming instructions or control code associated with operation of secondary appliance 200. The memory devices (i.e., memory) may represent random access memory such as DRAM or read only memory such as ROM or FLASH. In one embodiment, the processor executes programming instructions stored in memory. The memory may be a separate component from the processor or may be included onboard within the processor. Alternatively, SA controller 250 may be constructed without using a processor, for example, using a combination of discrete analog or digital logic circuitry (such as switches, amplifiers, integrators, comparators, flip-flops, AND gates, and the like) to perform control functionality instead of relying upon software.

In certain embodiments, SA controller 250 includes a SA network interface 282 such that SA controller 250 can connect to and communicate over one or more networks (e.g., network 190) with one or more network nodes.

Figure 3:
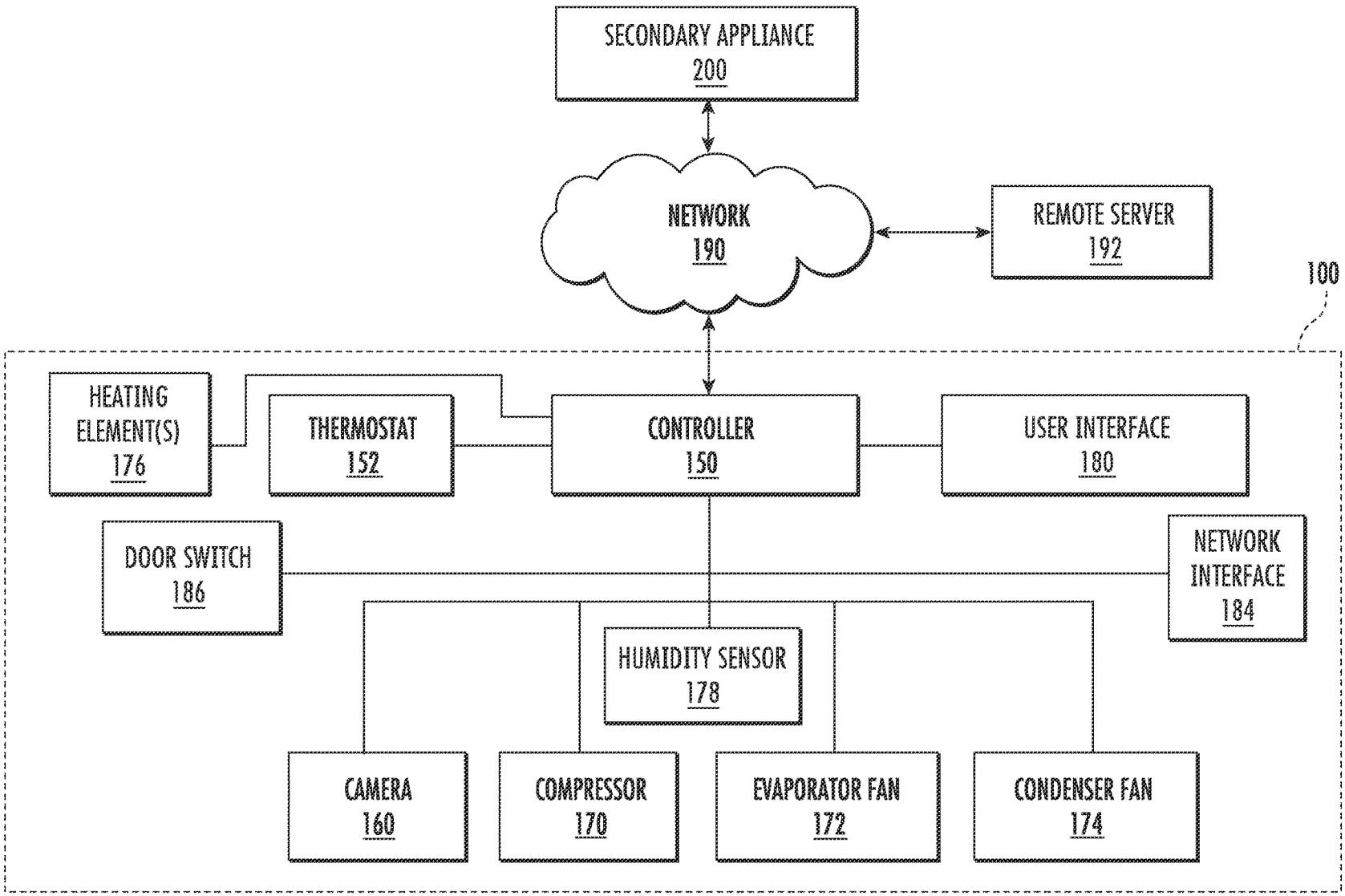
FIG. 3 provides a schematic view of an air-responsive system, including a refrigerator appliance, according to exemplary embodiments of the present disclosure.
Figure 5:
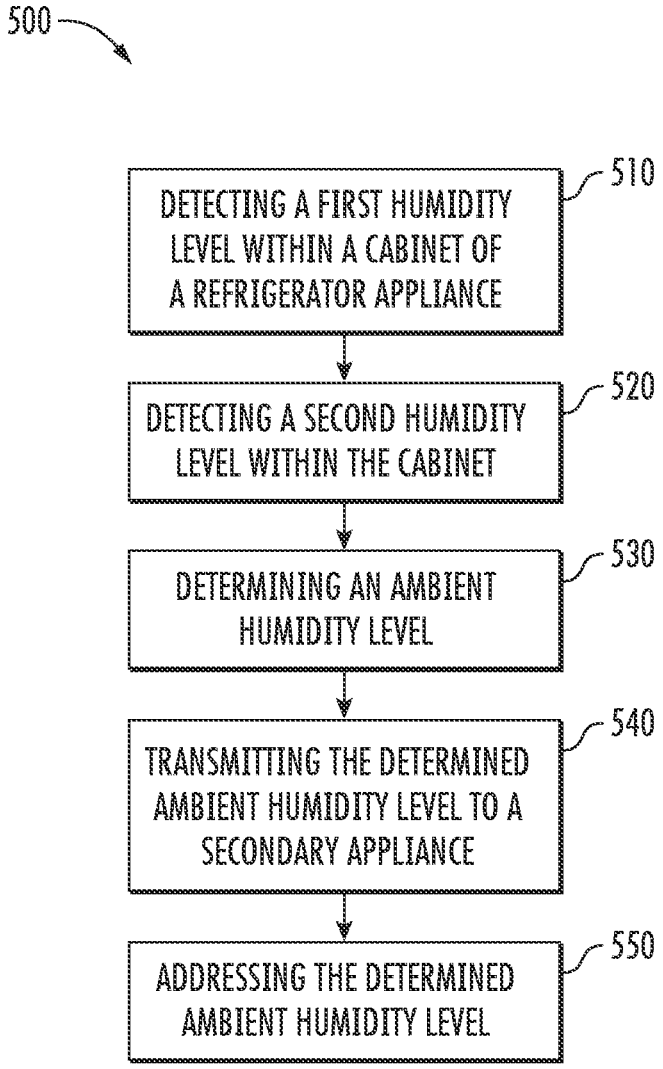
FIG. 5 provides a flow chart illustrating a method of operating a refrigerator appliance according to exemplary embodiments of the present disclosure.

Turning now to FIG. 5, a flow chart is provided of a method 500 according to exemplary embodiments of the present disclosure. Generally, FIG. 5 provides a method of operating a refrigerator appliance 100 (FIG. 1) that includes a humidity sensor 178, as described above. The method 500 can be performed, for instance, by the controller 150 (FIGS. 3 and 4). For example, controller 150 may, as discussed, be in communication with humidity sensor 178, secondary appliance 200 (FIG. 3), a door-detection assembly (e.g., camera 160 or door switch 186), or remote server(s) 192. During operations, controller 150 may send signals to and receive signals from humidity sensor 178, secondary appliance 200 (FIG. 3), a door-detection assembly (e.g., camera 160 or door switch 186), or remote server(s) 192. Controller 150 may further be operatively coupled to other suitable components of the appliance 100 to facilitate operation of the appliance 100 generally.

Advantageously, methods in accordance with the present disclosure may permit indirect detection ambient air conditions (e.g., such that such conditions may be addressed at the refrigerator appliance or by the secondary appliance). Notably, such methods may be performed without requiring a dedicated humidity sensor for directly detecting ambient humidity levels. Thus, an ambient humidity sensor may be absent from refrigerator appliance 100 or secondary appliance 200

FIG. 5 depicts steps performed in a particular order for purpose of illustration and discussion. Those of ordinary skill in the art, using the disclosures provided herein, will understand that the steps of any of the methods disclosed herein can be modified, adapted, rearranged, omitted, or expanded in various ways without deviating from the scope of the present disclosure (except as otherwise described).

At 510, the method 500 includes detecting a first humidity level within the cabinet. Specifically, the first humidity level may be detected at the humidity sensor (e.g., based on a signal received from the same) from air within the corresponding chilled chamber. The first humidity level may be a relative humidity value (e.g., defined as a percentage) or absolute humidity value (e.g., in $g/m^3$).

In some embodiments, the first humidity level may be detected in response to a corresponding door (e.g., refrigerator door) being in the open position. For instance, an open-door signal may be received (e.g., from the door switch or camera) to indicate the door is no longer completely closed. Once received, the open-door signal may prompt the humidity sensor to measure humidity (e.g., as the first humidity level). Alternatively, the open-door signal may prompt collection of a recently detected humidity value (e.g., measurement of humidity made according to a regular interval and less than minimum time period prior to reception of the open-door signal).

In certain embodiments, opening the door may initiate a timer (e.g., to detect the length of time in which the door is open). The timer may be incorporated in or as part of the controller, and would generally be understood in light of the present disclosure.

At 520, the method 500 includes detecting a second humidity level within the cabinet. Specifically, the second humidity level may be detected at the humidity sensor (e.g., based on a signal received from the same) from air within the corresponding chilled chamber (e.g., similar to 510). The second humidity level may be a relative humidity value (e.g., defined as a percentage) or absolute humidity value (e.g., in g/m$^3$). Specifically, the second humidity level may match the format or units of the first humidity level.

In some embodiments, the second humidity level may be detected when the door is in the closed position following 510. Optionally, 520 may be in response to a corresponding door (e.g., refrigerator door) being in the closed position. For instance, a closed-door signal may be received (e.g., from the door switch or camera) to indicate the door is again completely closed immediately after being opened. Once received, the closed-door signal may prompt the humidity sensor to measure humidity (e.g., as the second humidity level). Alternatively, the closed-door signal may prompt collection of a recently detected humidity value (e.g., measurement of humidity made according to a regular interval and less than minimum time period prior to reception of the closed-door signal).

As the door will have been opened for at least a period of time at 520, the state of air within the chilled chamber is likely to be significantly changed from 510. Specifically, the inflow of ambient air into the chilled chamber may alter the humidity level or air quality within the chilled chamber.

In certain embodiments, closing the door may halt the timer. Thus, the time in which the door is open (or the time between 510 and 520 generally) may be detected.

At 530, the method 500 includes determining an ambient humidity level outside of the cabinet based on the first and second humidity levels. The first and second humidity levels may generally indicate the ambient humidity level (e.g., according to a programmed formula, chart, table, or graph). In turn, the determination of ambient humidity level may be an indirect determination or estimate.

In some embodiments, 530 includes calculating a rate of humidity change (e.g., $dH_{dt}$) between the first humidity level and the second humidity level.

As an illustrative embodiment for 530, a calculation may be made for ambient humidity ($H_{ext}$) using a predetermined function, such as the exponential transition function for humidity (H):

$H=H_{ext}+(H_{in}-H_{ext})\exp(-t/T)$, wherein "T" is a predetermined or empirically set time constant, wherein "t" is measured time (e.g., as detected by the timer between 510 and 520), and wherein $H_{in}$ is internal humidity (e.g., first humidity level).

Thus, the derived humidity function is:

$$\frac{dH}{dt} = -\frac{(H_{ext} - H_{in})}{T}\exp\left(-\frac{t}{T}\right)$$

At t=0 (i.e., when the door opens) the derived humidity function becomes:

$$\frac{dH}{dt} = -\frac{(H_{ext} - H_{in})}{T}$$

From the above equations and known or predetermined values (e.g., $$\frac{dH}{dt},$$

$H_{in}$, and T), ambient humidity ($H_{ext}$) may be determined. It is noted that if ambient humidity is desired as an absolute humidity value, a measurement of ambient temperature may be detected (e.g., at a corresponding temperature sensor on the refrigerator appliance or secondary appliance), as would be understood in light of the present disclosure. Moreover, another similar transition/equilibrium function could be used, as would also be understood in light of the present disclosure.

Optionally, the determined ambient humidity level may be compared to one or more ambient thresholds. Thus, it may be determined if or when the ambient humidity level exceeds an ambient threshold.

At 540, the method 500 includes transmitting the determined ambient humidity level to the secondary appliance. For instance, the determined ambient humidity level may be transmitted as a determined humidity signal (e.g., directly or indirectly to the secondary appliance via a network, as generally described above).

At 550, the method 500 includes addressing the determined ambient humidity level. Specifically, operation of the refrigerator appliance or secondary appliance may be directed according to the determined ambient humidity level. For instance, the secondary appliance may be directed to perform a responsive action, such as by activating the air-treatment assembly to reduce humidity within the ambient air, cool the ambient air, or expel a portion of the ambient air, as would be understood in light of the present disclosure.

In some embodiments, 550 includes reducing a heat load of the refrigerator appliance based on the determined ambient humidity level. For instance, activation of the compressor may be limited in response to an ambient humidity level that is determined to be excessive (e.g., greater than an ambient threshold). In other words, the heat load of the refrigerator appliance may be reduced in response to determining the ambient humidity level exceeds an ambient threshold. Thus, generally high humidity levels may lead to reduced heat loads. The reduced heat load may continue for a set period of time. Alternatively, the reduced heat load may continue until a terminal condition is subsequently determined. Such a terminal condition may include receiving confirmation of a responsive action (e.g., based on a condition signal received from the secondary appliance following 540) or determining a subsequent ambient humidity level (e.g., by repeating the above steps and according to a new set of first and second humidity levels) that is less than an ambient threshold.

In additional or alternative embodiments, 550 includes activating a heating element within the cabinet based on the determined ambient humidity level. As described above, one or more heating elements may be provided to reduce condensation on the cabinet. In turn, a determination of certain humidity levels may prompt heating element activation to reduce condensation. Optionally, an ambient humidity level that is determined to be excessive (e.g., greater than an ambient threshold) may prompt activation of the heating elements. Thus, generally high humidity levels may lead to activation of one or more heating elements. Activation of the heating element(s) may continue for a set period of time. Alternatively, the activation may continue until a terminal condition is subsequently determined. Such a terminal condition may include receiving confirmation of a responsive action (e.g., based on a condition signal received from the secondary appliance following 540) or determining a subsequent ambient humidity level (e.g., by repeating the above steps and according to a new set of first and second humidity levels) that is less than an ambient threshold.

In further additional or alternative embodiments, 550 increasing a setpoint temperature to an increased temperature value from an original temperature value. Specifically, the setpoint for the chilled chamber may be increased (e.g., by a set amount or according to a set function based on the determined ambient humidity level). The increase may be between 0.5° Fahrenheit and 5° Fahrenheit. Thus, a determination of certain humidity levels may prompt an increase in temperature within the chilled chamber to reduce condensation. Optionally, an ambient humidity level that is determined to be excessive (e.g., greater than an ambient threshold) may prompt the increase. Thus, generally high humidity levels may lead to increasing the setpoint of the chilled chamber. The increased setpoint may be maintained for a set period of time. Alternatively, the increase may be maintained until a terminal condition is subsequently determined. Such a terminal condition may include receiving confirmation of a responsive action (e.g., based on a condition signal received from the secondary appliance following 540) or determining a subsequent ambient humidity (e.g., by repeating the above steps and according to a new set of first and second humidity levels) that is less than an ambient threshold. As an example, the setpoint temperature maybe returned to the original temperature value from the increased temperature value in response to receiving a condition signal from the secondary appliance. Thus, operation of the refrigerator appliance may return to the setpoint, mode, or status that was maintained prior to 510.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance comprising:

a cabinet defining a chilled chamber;

a door being rotatably hinged to the cabinet to move between an open position and a closed position;

a humidity sensor mounted to the cabinet within the chilled chamber; and a controller operably coupled to the humidity sensor, the controller being configured to initiate an operation routine comprising detecting a first humidity level within the cabinet in response to the door being in the open position, detecting a second humidity level within the cabinet when the door is in the closed position following detecting the first humidity level, determining an ambient humidity level outside of the cabinet based on the first and second humidity levels, and transmitting the determined ambient humidity level to a secondary appliance.

2. The refrigerator appliance of claim 1, wherein the operation routine further comprises receiving an open-door signal from a door sensor mounted to the cabinet, wherein detecting the first humidity level is in response to receiving the open-door signal.

3. The refrigerator appliance of claim 1, wherein the operation routine further comprises receiving a closed-door signal from a door sensor mounted to the cabinet, wherein detecting the second humidity level is in response to receiving the closed-door signal.

4. The refrigerator appliance of claim 1, wherein determining the ambient humidity level comprises calculating a rate of humidity change between the first humidity level and the second humidity level.

5. The refrigerator appliance of claim 1, wherein the operation routine further comprises reducing a heat load of the refrigerator appliance based on the determined ambient humidity level.

6. The refrigerator appliance of claim 5, wherein determining the ambient humidity level comprises determining the ambient humidity level exceeds an ambient threshold, and wherein reducing the heat load is in response to determining the ambient humidity level exceeds the ambient threshold.

7. The refrigerator appliance of claim 1, wherein the operation routine further comprises activating a heating element attached to the cabinet based on the determined ambient humidity level.

8. The refrigerator appliance of claim 1, wherein the operation routine further comprises increasing a setpoint temperature to an increased temperature value from an original temperature value within the cabinet based on the determined ambient humidity level.

9. The refrigerator appliance of claim 8, wherein the operation routine further comprises receiving a condition signal from the secondary appliance, and returning the setpoint temperature to the original temperature value from the increased temperature value in response to receiving the condition signal from the secondary appliance.

10. A method of operating a refrigerator appliance, the method comprising;

detecting a first humidity level within a cabinet of the refrigerator appliance in response to a door of the refrigerator appliance being in an open position;

detecting a second humidity level within the cabinet when the door is in a closed position following detecting the first humidity level;

determining an ambient humidity level outside of the cabinet based on the first and second humidity levels; and transmitting the determined ambient humidity level to a secondary appliance.

11. The method of claim 10, further comprising receiving an open-door signal from a door sensor mounted to the cabinet, wherein detecting the first humidity level is in response to receiving the open-door signal.

12. The method of claim 10, further comprising:

receiving a closed-door signal from a door sensor mounted to the cabinet, wherein detecting the second humidity level is in response to receiving the closed-door signal.

13. The method of claim 10, wherein determining the ambient humidity level comprises calculating a rate of humidity change between the first humidity level and the second humidity level.

14. The method of claim 10, further comprising:

reducing a heat load of the refrigerator appliance based on the determined ambient humidity level.

15. The method of claim 14, wherein determining the ambient humidity level comprises determining the ambient humidity level exceeds an ambient threshold, and wherein reducing the heat load is in response to determining the ambient humidity level exceeds the ambient threshold.

16. The method of claim 10, further comprising:

activating a heating element attached to the cabinet based on the determined ambient humidity level.

17. The method of claim 10, further comprising:

increasing a setpoint temperature to an increased temperature value from an original temperature value within the cabinet based on the determined ambient humidity level.

18. The method of claim 17, further comprising:

receiving a condition signal from the secondary appliance; and returning the setpoint temperature to the original temperature value from the increased temperature value in response to receiving the condition signal from the secondary appliance.

* * * * *